US010134241B2

(12) United States Patent
Berman et al.

(10) Patent No.: US 10,134,241 B2
(45) Date of Patent: Nov. 20, 2018

(54) GAMING DEVICE AND METHOD FOR POKER GAME HAVING ADDITIONAL AWARD OPPORTUNITIES

(71) Applicant: KING SHOW GAMES, INC., Minnetonka, MN (US)

(72) Inventors: Bradley Berman, Minnetonka, MN (US); Chad Shapiro, Plymouth, MN (US)

( * ) Notice: Subject to any disclaimer, the term of this patent is extended or adjusted under 35 U.S.C. 154(b) by 151 days.

(21) Appl. No.: 15/234,916

(22) Filed: Aug. 11, 2016

(65) Prior Publication Data

US 2017/0046923 A1 Feb. 16, 2017

Related U.S. Application Data

(60) Provisional application No. 62/203,896, filed on Aug. 11, 2015.

(51) Int. Cl.
*A63F 1/00* (2006.01)
*G07F 17/32* (2006.01)

(52) U.S. Cl.
CPC ..... *G07F 17/3293* (2013.01); *G07F 17/3209* (2013.01); *G07F 17/3211* (2013.01); *G07F 17/3251* (2013.01); *G07F 17/3267* (2013.01); *A63F 1/00* (2013.01); *A63F 2001/005* (2013.01)

(58) Field of Classification Search
CPC ..... A63F 1/00; A63F 2001/005
See application file for complete search history.

(56) References Cited

U.S. PATENT DOCUMENTS

| | | | | |
|---|---|---|---|---|
| 4,743,022 | A | 5/1988 | Wood | |
| 5,823,873 | A | 10/1998 | Moody | |
| 6,007,066 | A | 12/1999 | Moody | |
| 6,098,985 | A | 8/2000 | Moody | |
| 6,206,780 | B1 | 3/2001 | Awada | |
| 6,371,483 | B1 | 4/2002 | Edmunds et al. | |
| 6,517,074 | B1 | 2/2003 | Moody et al. | |
| 6,612,927 | B1 | 9/2003 | Slomiany et al. | |
| 6,652,377 | B1 | 11/2003 | Moody | |
| 6,705,943 | B2 * | 3/2004 | Awada | G07F 17/32 273/292 |
| 6,877,747 | B2 | 4/2005 | Moody | |
| 7,247,092 | B2 | 7/2007 | Jarvis et al. | |
| 7,297,057 | B2 | 11/2007 | Gerrard et al. | |
| 7,419,159 | B2 | 9/2008 | Dodge | |
| 7,588,251 | B1 | 9/2009 | Schultz et al. | |
| 7,690,976 | B2 | 4/2010 | Edidin et al. | |
| 7,926,813 | B2 | 4/2011 | Moody | |
| 8,147,310 | B2 | 4/2012 | Jarvis et al. | |

(Continued)

OTHER PUBLICATIONS

IGT, "2nd Chance Royal Poker Brochure", 2010, 2 pages.
Sigma Games, "Ten Seven Poker Brochure", 2002, 3 pages.

*Primary Examiner* — James S McClellan
*Assistant Examiner* — Syvila Weatherford

(57) ABSTRACT

Embodiments of the present invention set forth systems, apparatuses and methods for facilitating a poker game having additional award opportunities. Accordingly, a gaming device can be configured to include a display, a player interface, and a processor configured to deal a first poker hand and evaluate the first poker hand. The processor is further configured to deal at least one additional card to the first poker hand to create a second poker hand, and to then evaluate the second poker hand.

19 Claims, 15 Drawing Sheets

(56) References Cited

U.S. PATENT DOCUMENTS

| | | | | |
|---|---|---|---|---|
| 8,419,518 | B2 | 4/2013 | Jarvis et al. | |
| 9,138,634 | B2 | 9/2015 | Moody | |
| 9,147,321 | B2 | 9/2015 | Moody | |
| 9,424,714 | B2 | 8/2016 | Moody | |
| 2005/0059451 | A1 | 3/2005 | Shackleford | |
| 2017/0039812 | A1* | 2/2017 | Baron | G07F 17/3293 |

* cited by examiner

GAMING DEVICE AND METHOD FOR POKER GAME HAVING ADDITIONAL AWARD OPPORTUNITIES

RELATED APPLICATIONS

This application claims the benefit of Provisional Patent Application No. 62/203,896, filed on Aug. 11, 2015, to which priority is claimed pursuant to 35 U.S.C. § 119(e) and which is incorporated herein by reference in its entirety.

FIELD OF THE INVENTION

This disclosure relates generally to games, and more particularly to systems, apparatuses and methods for providing poker games having additional award opportunities in gaming devices.

BACKGROUND

Casino games such as poker, slots, and craps have long been enjoyed as a means of entertainment. Some of these games originated using traditional elements such as playing cards or dice. More recently, gaming devices have been developed to simulate and/or further enhance these games while remaining entertaining. The popularity of casino gambling with wagering continues to increase, as does recreational gambling such as non-wagering computer game gambling. Part of this popularity is the increased development of new types of games that are implemented, at least in part, on gaming devices.

One reason that casino games are widely developed for gaming devices is that a wide variety of games can be implemented on gaming devices, thereby providing an array of choices for players looking to gamble. For example, the graphics and sounds included in such games can be modified to reflect popular subjects, such as movies and television shows. Game play rules and types of games can also vary greatly providing many different styles of gambling. Additionally, gaming devices require minimal supervision to operate on a casino floor, or in other gambling environments. That is, as compared to traditional casino games that require a dealer, banker, stickman, pit managers, etc., gaming devices need much less employee attention to operate.

With the ability to provide new content, players have come to expect the availability of an ever wider selection of new games when visiting casinos and other gaming venues. Playing new games adds to the excitement of "gaming" As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill, although some skill may be an element in some types of games. Since random chance is a significant component of these games, they are sometimes referred to as "games of chance."

The present disclosure describes methods, systems, and apparatus that provide for new and interesting gaming experiences, and that provide other advantages over the prior art.

SUMMARY

To overcome limitations in the prior art described above, and to overcome other limitations that will become apparent upon reading and understanding the present specification, embodiments of the present invention are directed to an apparatus, system, computer readable storage media, and/or method that involve or otherwise facilitate a poker game having additional award opportunities. In one embodiment, a gaming device includes a display, a player interface, and a processor configured to deal a first poker hand and evaluate the first poker hand. The processor is further configured to deal at least one additional card to the first poker hand to create a second poker hand, and to then evaluate the second poker hand.

DETAILED DESCRIPTION

Figure 1:
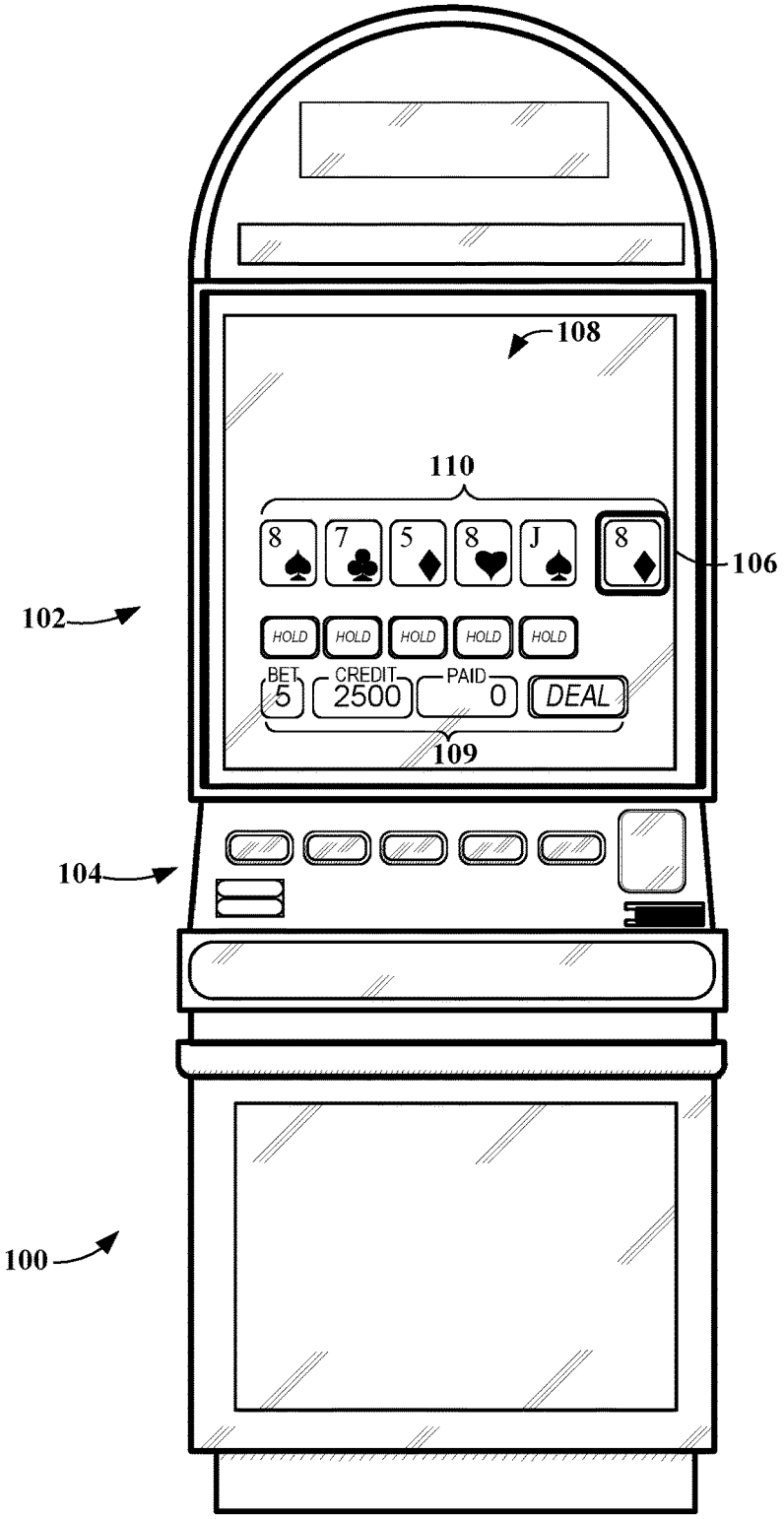
FIG. 1 is a diagram of a gaming machine according to embodiments of the invention.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatus.

In various embodiments of the invention, the gaming displays are described in conjunction with the use of data in the form of "symbols." In the context of this disclosure, a "symbol" may generally refer at least to a collection of one or more arbitrary indicia or signs that have some conventional significance. In particular, the symbol represents values that can at least be used to determine whether to award a payout. A symbol may include numbers, letters, shapes, pictures, textures, colors, sounds, etc., and any combination therebetween. A win can be determined by comparing the symbol with another symbol. Generally, such comparisons can be performed via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for enhancing winning result opportunities in gaming activities. The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. slot game) are provided for purposes of facilitating an understanding of the features described herein. However, the principles described herein are equally applicable to any game of chance where an outcome(s) is determined for use in the player's gaming activity.

Embodiments of the present concept include providing gaming devices (also referred to as gaming apparatuses or gaming machines), gaming systems, and methods of operating these devices or systems to provide game play that provide poker games having additional award opportunities. In some embodiments, these additional award opportunities are provided by dealing one or more additional cards after a first poker hand is dealt and evaluated. These additional cards can be combined with the cards of the first poker hand to generate a second poker hand, which is then evaluated. The evaluation of the first and second poker hands may be done respectively utilizing a first and second paytable, or may both be completed with respect to a single paytable.

In some embodiments, players may place a bonus bet to wager on the second poker hand with the additional cards. However, in other embodiments, a single wager may be used with the pays in the one or more paytables being reduced to account for the game's hold or amount of wagers not theoretically returned during play. In various embodiments, the first poker hand may be a stud poker hand, draw poker hand, or other type of card hand that is evaluated using a paytable. The second hand may also be evaluated as a stud poker hand, draw poker hand, or other type of card hand that is evaluated using a paytable. For example, if additional cards are simply added to a stud or draw poker hand, they may be evaluated as a stud poker hand using additional cards. In another example, after the additional cards are added to the first poker hand, the player may be able to hold cards and draw to generate the second poker hand. That is, in the first example a game operation may include 1) dealing 5 cards, 2) allowing a player to hold and draw cards to create a final 5-card draw poker hand, 3) evaluating the draw poker hand for awards using a 5-card draw poker paytable, 4) dealing two additional cards, and 5) evaluating the second 7-card poker hand as a 7-card stud hand using a 7-card paytable. In the second example, a game operation may include 1) dealing 5 cards, 2) evaluating the 5-card stud poker hand using a 5-card stud poker paytable, 3) dealing two additional cards, 4) allowing a player to hold and draw cards to create a second-draw poker hand, and 5) evaluate the second hand using a 7-card poker paytable. These steps may be interchanged, or replaced with different steps in other embodiments.

As shown below, these inventive principles can be applied to embodiments that use multiple hands, such as multi-play hands or multiple separate poker hands. The second poker hands can be evaluated using, for example, a seven card paytable when two additional cards are added to the first hand, or the best 5-card hand may be used out of the 7 total cards and evaluated using a five card poker paytable.

Numerous variations are possible using these and other embodiments of the inventive concept. Some of these embodiments and variations are discussed below with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, or other games of chance. Some of these other types of embodiments will be discussed below as variations to the examples illustrated. However, many other types of games can implement similar techniques and fall within the scope of this inventive concept.

Referring to the example gaming apparatus 100 shown in FIG. 1, the gaming apparatus includes a display area 102 (also referred to as a gaming display), and a player interface area 104, although some or all of the interactive mechanisms included in the user interface area 104 may be provided via graphical icons used with a touch screen in the display area 102 in some embodiments. The display area 102 may include one or more game displays 106 (also referred to as "displays" or "gaming displays") that may be included in physically separate displays or as portions of a common large display. Here, the game display 106 includes a primary game play portion 108 that displays game elements and symbols 110, and an operations portion 109 that can include meters, various game buttons, or other game information for a player of the gaming device 100.

The user interface 104 allows the user to control and engage in play of the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, or any other user input system or mechanism that allows the user to play the particular gaming activity.

The user interface 104 may allow the user or player to enter coins, bills, or otherwise obtain credits through vouchers, tokens, credit cards, tickets, etc. Various mechanisms for entering such vouchers, tokens, credit cards, coins, tickets, etc. are described below with reference to FIG. 2. For example, currency input mechanisms, card readers, credit card readers, smart card readers, punch card readers, radio frequency identifier (RFID) readers, and other mechanisms may be used to enter wagers. The user interface 104 may also include a mechanism to read and/or validate player loyalty information to identify a user or player of the gaming device. This mechanism may be card reader, biometric scanner, keypad, or other input device. It is through the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touchscreen, entering text, entering voice commands, or other known data entry methodology.

The game display 106 in the display area 102 may include one or more of an electronic display, a video display, a mechanical display, and fixed display information, such as paytable information associated with a glass/plastic panel on the gaming machine 100 and/or graphical images. The symbols or other indicia associated with the play of the game may be presented on an electronic display device or on mechanical devices associated with a mechanical display. Generally, the display 106 devotes the largest portion of viewable area to the primary gaming portion 108. The primary gaming portion 108 is generally where the visual feedback for any selected game is provided to the user. The primary gaming portion 108 may render graphical objects such as cards, slot reels, dice, animated characters, and any other gaming visual known in the art. The primary gaming portion 108 also typically informs players of the outcome of any particular event, including whether the event resulted in a win or loss.

In some the example embodiments illustrated herein, the primary gaming portion 108 may display a grid (or equivalent arrangement) of playing cards 110 forming a hand. Here, the grid includes a row of five playing cards 110 forming a video poker hand, which represents a portion of a game play event. For example, if the game play event is a video draw poker game, the gaming device 100 may deal five cards, allow the user to select which cards to hold, deal replacements for the cards not held, and determine a payout based on the final cards in the hand. The illustration and description of five-card-draw poker is for purposes of example and not of limitation; the present invention may be applicable to numerous other card games, such as stud poker or hold 'em poker, as well as other types of gaming activities and apparatuses, such as slot machines, dice, coins, etc.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual cards for holding prior to draw of new cards. The game display 106 of the display area 102 may include other features that are not shown, such as paytables, navigation controls, etc.

Figure 2:
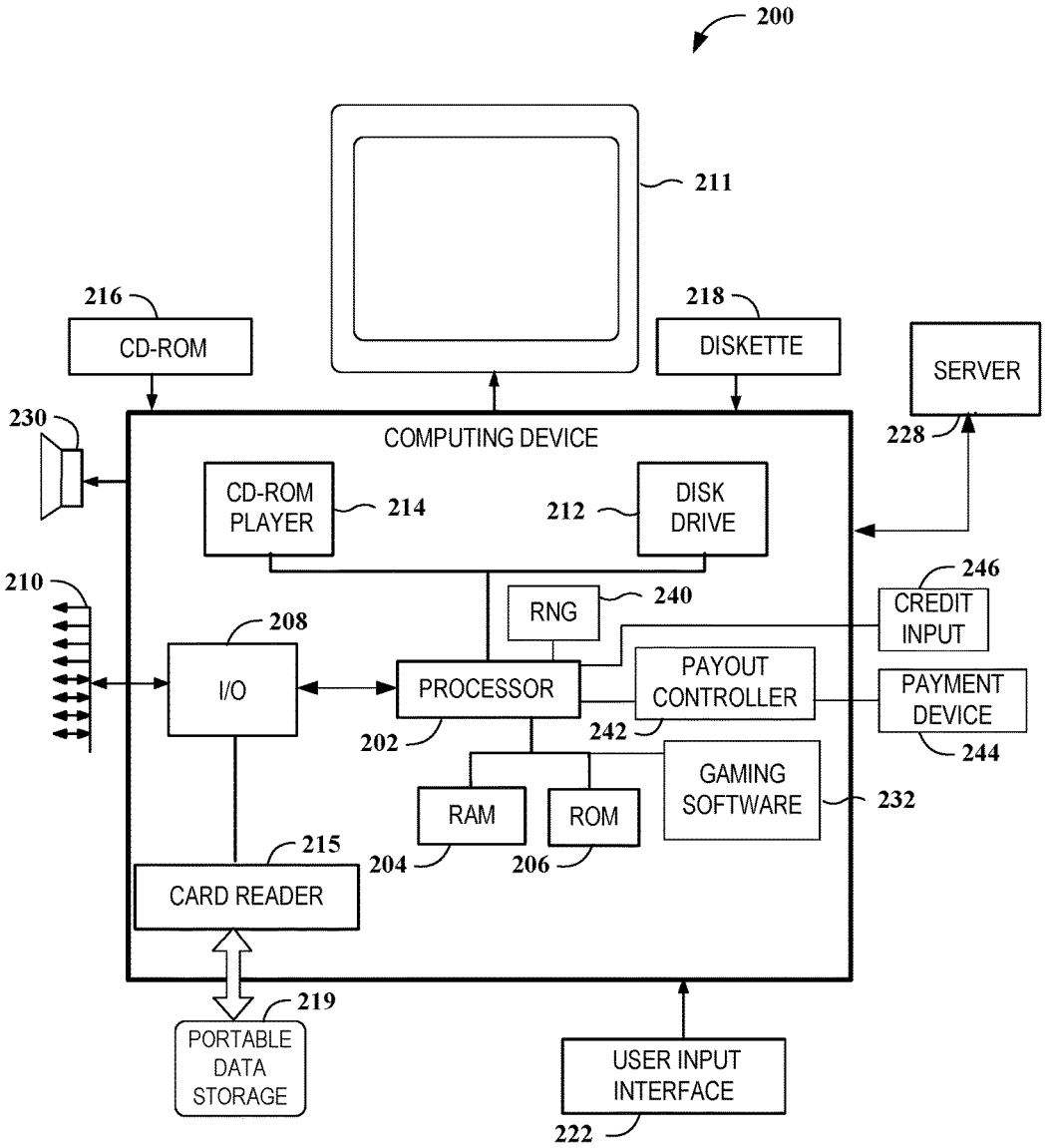
FIG. 2 is a block diagram illustrating a computing arrangement according to embodiments of the invention.

Although FIG. 1 illustrates a particular implementation of some of the embodiments of this invention in a casino or electronic gaming machine ("EGM"), one or more devices may be programmed to play various embodiments of the invention. The present invention may be implemented, as shown in FIG. 1, as a casino gaming machine or other special purpose gaming kiosk as described herein, or may be implemented via computing systems operating under the direction of local gaming software, and/or remotely-provided software such as provided by an application service provider (ASP). Casino gaming machines may also utilize computing systems to control and manage the gaming activity, although these computing systems typically include specialized components and/or functionality to operate the particular elements of casino gaming machines. Additionally, computing systems operating over networks, such as the Internet, may also include specialized components and/or functionality to operate elements particular to these systems, such as random number generators. An example of a representative computing system capable of carrying out operations in accordance with the invention is illustrated in FIG. 2.

Hardware, firmware, software or a combination thereof may be used to perform the various gaming functions, display presentations and operations described herein. The functional modules used in connection with the invention may reside in a gaming machine as described, or may alternatively reside on a stand-alone or networked computer. The computing structure 200 of FIG. 2 is an example computing structure that can be used in connection with such electronic gaming machines, computers, or other computer-implemented devices to carry out operations of the present invention. Although numerous components or elements are shown as part of this computing structure 200 in FIG. 2, additional or fewer components may be utilized in particular implementations of embodiments of the invention.

The example computing arrangement 200 suitable for performing the gaming functions in accordance with the present invention typically includes a central processor (CPU) 202 coupled to random access memory (RAM) 204 and some variation of read-only memory (ROM) 206. The ROM 206 may also represent other types of storage media to store programs, such as programmable ROM (PROM), erasable PROM (EPROM), etc. The processor 202 may communicate with other internal and external components through input/output (I/O) circuitry 208 and bussing 210, to provide control signals, communication signals, and the like.

The computing arrangement 200 may also include one or more data storage devices, including hard and floppy disk drives 212, CD-ROM drives 214, card reader 215, and other hardware capable of reading and/or storing information such as DVD, etc. In one embodiment, software for carrying out the operations in accordance with the present invention may be stored and distributed on a CD-ROM 216, diskette 218, access card 219, or other form of computer readable media capable of portably storing information. These storage media may be inserted into, and read by, devices such as the CD-ROM drive 214, the disk drive 212, card reader 215, etc. The software may also be transmitted to the computing arrangement 200 via data signals, such as being downloaded electronically via a network, such as local area network (casino, property, or bank network) or a wide area network (e.g., the Internet). Further, as previously described, the software for carrying out the functions associated with the present invention may alternatively be stored in internal memory/storage of the computing device 200, such as in the ROM 206.

The computing arrangement 200 is coupled to the display 211, which represents a display on which the gaming activities in accordance with the invention are presented. The display 211 represents the "presentation" of the game information in accordance with the invention, and may be a mechanical display showing physical spinning reels, a video display, such as liquid crystal displays, plasma displays, cathode ray tubes (CRT), digital light processing (DLP)

displays, liquid crystal on silicon (LCOS) displays, etc., or any type of known display or presentation screen.

Where the computing device 200 represents a stand-alone or networked computer, the display 211 may represent a standard computer terminal or display capable of displaying multiple windows, frames, etc. Where the computing device 200 represents a mobile electronic device, the display 211 may represent the video display of the mobile electronic device. Where the computing device 200 is embedded within an electronic gaming machine, the display 211 corresponds to the display screen of the gaming machine/kiosk.

A user input interface 222 such as a mouse, keyboard/keypad, microphone, touch pad, trackball, joystick, touch screen, voice-recognition system, card reader, biometric scanner, RFID detector, etc. may be provided. The user input interface 222 may be used to input commands in the computing arrangement 200, such as placing wagers or initiating gaming events on the computing arrangement 200, inputting currency or other payment information to establish a credit amount or wager amount, or inputting data to identify a player for a player loyalty system. The display 211 may also act as a user input device, e.g., where the display 211 is a touchscreen device. In embodiments, where the computing device 200 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG). The fixed and dynamic symbols generated as part of a gaming activity may be produced using one or more RNGs. RNGs may be implemented using hardware, software operable in connection with the processor 202, or some combination of hardware and software. The present invention is operable using any known RNG, and may be integrally programmed as part of the processor 202 operation, or alternatively may be a separate RNG controller 240. The RNGs are often protected by one or more security measures to prevent tampering, such as by using secured circuitry, locks on the physical game cabinet, and/or remote circuitry that transmits data to the gaming device.

The computing arrangement 200 may be connected to other computing devices or gaming machines, such as via a network. The computing arrangement 200 may be connected to a network server 228 in an intranet or local network configuration. The computer may further be part of a larger network configuration as in a global area network (GAN) such as the Internet. In such a case, the computer may have access to one or more web servers via the Internet. In other arrangements, the computing arrangement 200 may be configured as an Internet server and software for carrying out the operations in accordance with the present invention may interact with the player via one or more networks. The computing arrangement 200 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 200 may also include a payout controller 242 to receive a signal from the processor 202 indicating a payout is to made to a player and controlling a payout device 244 to facilitate payment of the payout to the player. In some embodiments, the payout controller 242 may independently determine the amount of payout to be provided to the participant or player. In other embodiments, the payout controller 242 may be integrally implemented with the processor 202. The payout controller 242 may be a hopper controller, a print driver, credit-transmitting device, bill-dispensing controller, accounting software, or other controller device configured to verify and/or facilitate payment to a player.

A payout device 244 may also be provided in gaming machine embodiments, where the payout device 244 serves as the mechanism providing the payout to the player or participant. In some embodiments, the payout device may be a hopper, where the hopper serves as the mechanism holding the coins/tokens of the machine, and/or distributing the coins/tokens to the player in response to a signal from the payout controller 242. In other embodiments, the payout device 244 may be a printer mechanism structured to print credit-based tickets that may be redeemed by the player for cash, credit, or other casino value-based currency. In yet other embodiments, the payout device 244 may send a signal via the network server 228 or other device to electronically provide a credit amount to an account associated with the player, such as a credit card account or player loyalty account. The computing arrangement 200 may also include accounting data stored in one of the memory devices 204, 206. This accounting data may be transmitted to a casino accounting network or other network to manage accounting statistics for the computing arrangement or to provide verification data for the currency or currency-based tickets distributed by the payout device, such as providing the data associated with the bar codes printed on the currency-based tickets so they are identifiable as valid tickets for a particular amount when the player redeems them or inserts them in another gaming device.

The wager input module or device 246 represents any mechanism for accepting coins, tokens, coupons, bills, electronic fund transfer (EFT), tickets, credit cards, smart cards, membership/loyalty cards, etc., for which a participant inputs a wager amount. The wager input device 246 may include magnetic strip readers, bar code scanners, light sensors, or other detection devices to identify and validate physical currency, currency-based tickets, cards with magnetized-strips, or other medium inputted into the wager input device. When a particular medium is received in the wager input device 246, a signal may be generated to establish or increase an available credit amount or balance stored in the internal memory/storage of the computing device 200, such as in the RAM 204. Thereafter, specific wagers placed on games may reduce the available credit amount, while awards won may increase the available credit amount. It will be appreciated that the primary gaming software 232 may be able to control payouts via the payout device 244 and payout controller 242 for independently determined payout events.

Among other functions, the computing arrangement 200 provides an interactive experience to players via an input interface 222 and output devices, such as the display 211, speaker 230, etc. These experiences are generally controlled by gaming software 232 that controls a primary gaming activity of the computing arrangement 200. The gaming software 232 may be temporarily loaded into RAM 204, and may be stored locally using any combination of ROM 206, drives 212, media player 214, or other computer-readable storage media known in the art. The primary gaming software 232 may also be accessed remotely, such as via the server 228 or the Internet.

The primary gaming software 232 in the computing arrangement 200 may be an application software module.

According to embodiments of the present invention, this software 232 provides a slot game or similar game of chance as described hereinabove. For example, the software 232 may present, by way of the display 211, representations of symbols to map or otherwise display as part of a slot based game having reels. However, in other embodiments, the principles of this concept may be applied to poker games or other types of games of chance. One or more aligned positions of these game elements may be evaluated to determine awards based on a paytable. The software 232 may include instructions to provide other functionality as known in the art or as described and shown herein.

Figure 3:
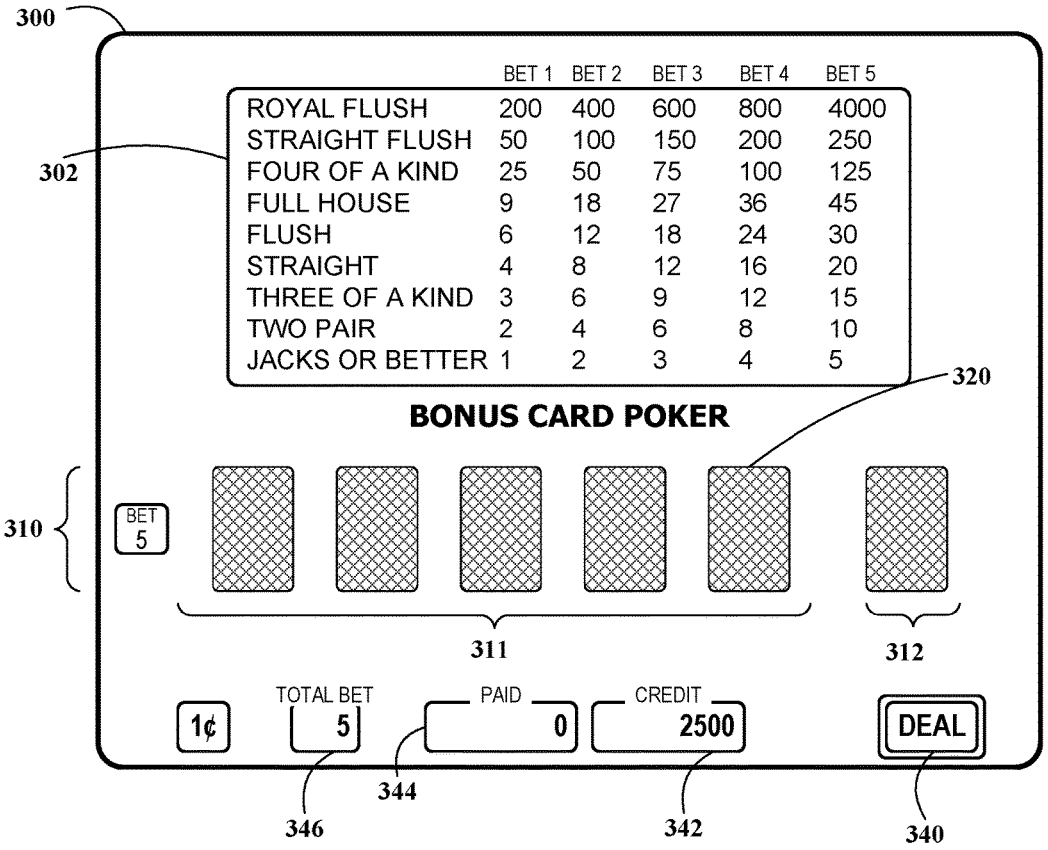
FIG. 3 is a diagram of a display of a gaming device showing a poker game having additional award opportunities according to embodiments.

FIG. 3 is a diagram of a display of a gaming device showing a poker game having additional award opportunities according to embodiments. Referring to FIG. 3, a gaming display 300 of a gaming device includes a poker paytable 302, a game play area having a poker hand 310 of playing cards 320, and a player interface area having a total bet meter 346, a paid meter 344, a credit meter 342, and a Deal/Draw button 340. Although this embodiment shows particular features, these features may be different in other embodiments.

The poker hand 310 includes a first portion of card positions 311, which in this embodiment is five card positions making a 5-card first poker hand, and a second portion of card positions 312, which in this embodiment is a single additional card. In operation, five cards are dealt to the first portion of card positions 311 to generate a first poker hand. This first poker hand may be evaluated using the displayed poker paytable 302. An additional card is then dealt to the second card position 312 to create a second poker hand along with the five cards in the first portion of cards positions 311. This second poker hand may be evaluated using six card poker paytable (not shown), or the best 5-card poker hand may be evaluated using the displayed paytable 302.

Figure 4:
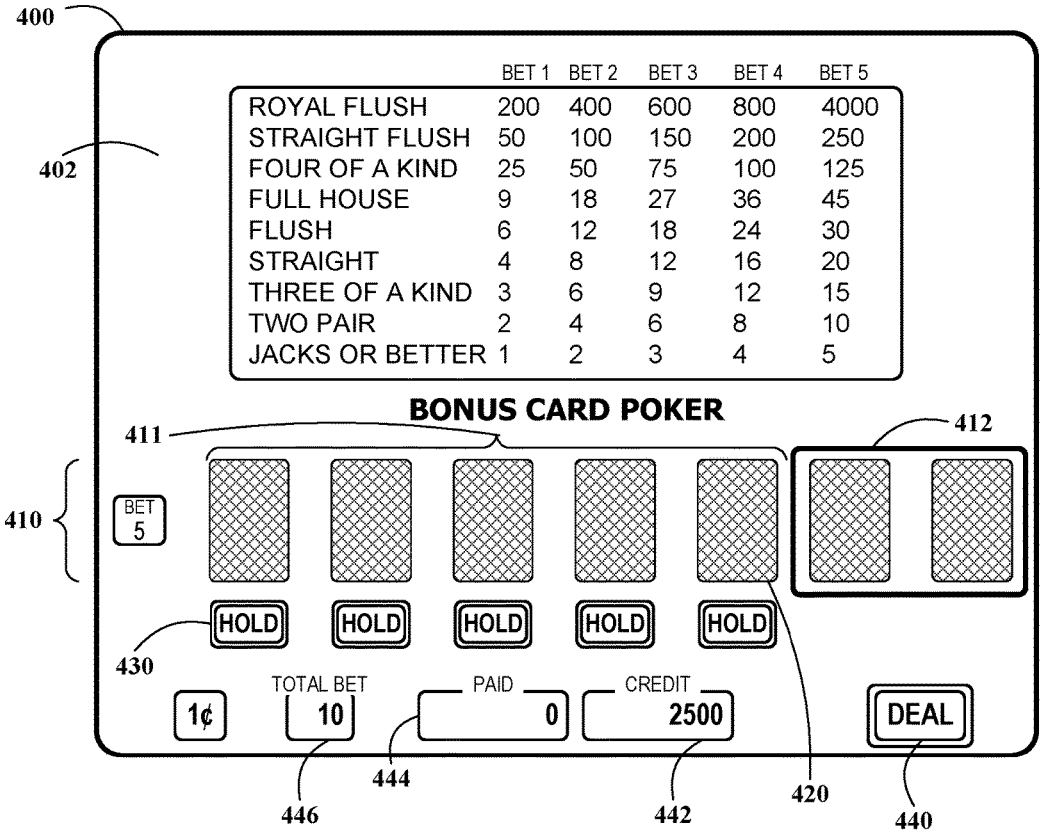
FIG. 4 is a diagram of a display of a gaming device showing another poker game having additional award opportunities according to embodiments.

FIG. 4 is a diagram of a display of a gaming device showing another poker game having additional award opportunities according to embodiments. Referring to FIG. 4, a gaming display 400 of a gaming device includes a poker paytable 402, a game play area having a poker hand 410 of playing cards 420, and a player interface area having hold buttons 430, a total bet meter 446, a paid meter 444, a credit meter 442, and a Deal/Draw button 440. Although this embodiment shows particular features, these features may be different in other embodiments.

The poker hand 410 includes a first portion of card positions 411, which along with the hold buttons 430 are used to make a 5-card first draw poker hand, and a second portion of card positions 412, which in this embodiment are two additional cards. In operation, five cards are dealt to the first portion of card positions 411. These dealt cards may be held using the hold buttons 430 or other holding mechanisms, and draw cards are drawn to replace any cards not held to generate a first poker hand. This first poker hand may be evaluated using the displayed poker paytable 402. Two additional cards are then dealt to the second card positions 412 to create a second poker hand along with the five cards in the first portion of cards positions 411. This second poker hand may be evaluated using seven card poker paytable (not shown), or the best 5-card poker hand may be evaluated using the displayed paytable 402.

Figure 5:
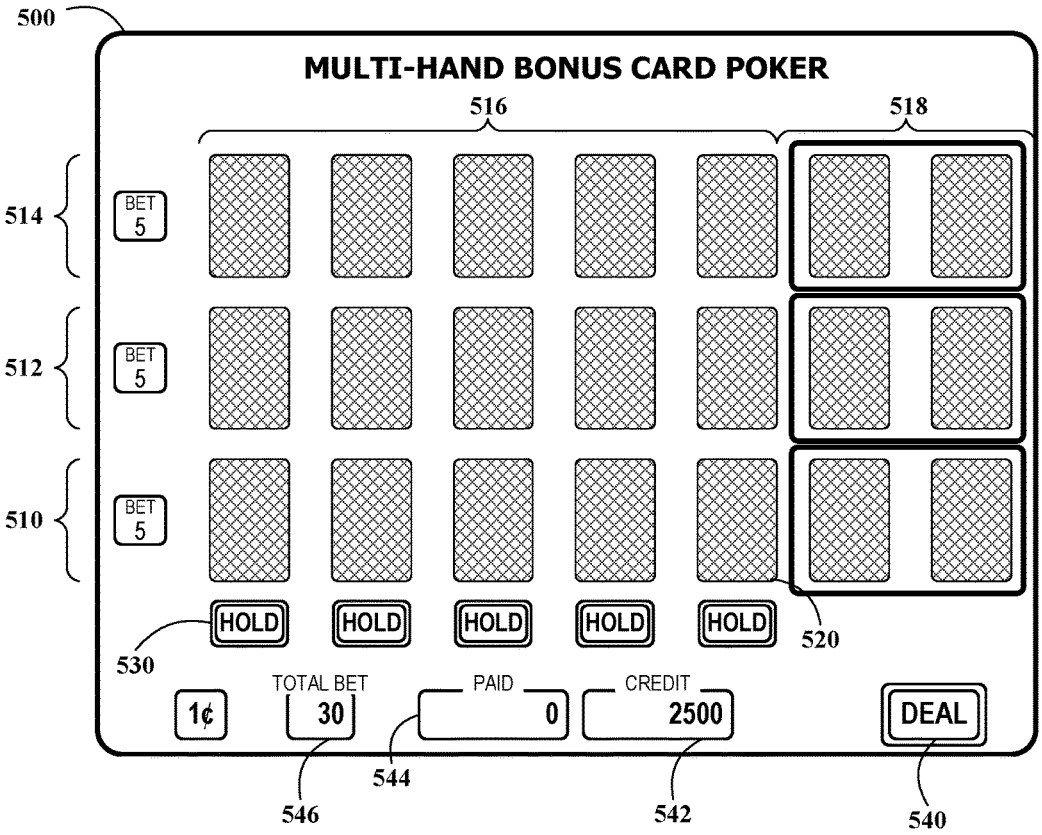
FIG. 5 is a diagram of a display of a gaming device showing another poker game having additional award opportunities according to embodiments.

FIG. 5 is a diagram of a display of a gaming device showing another poker game having additional award opportunities according to embodiments. Referring to FIG. 5, a gaming display 500 of a gaming device includes a game play area having a first poker stage 510 of playing cards 520, a second poker stage 512 of player cards, a third poker stage 514 of playing cards, and a player interface area having hold buttons 530, a total bet meter 546, a paid meter 544, a credit meter 542, and a Deal/Draw button 540. Although this embodiment shows particular features, these features may be different in other embodiments.

Each of the poker stages 510, 512, 514 include a first portion of card positions 516, which along with the hold buttons 530 are used to make a 5-card first draw poker hands, and a second portion of card positions 518, which in this embodiment are two additional card. In operation, five cards are dealt to the first portion of card positions 516 of the first poker stage. These dealt cards may be held using the hold buttons 530 or other holding mechanisms. In multi-play embodiments, these held cards may be replicated to the corresponding card positions in the second poker stage 512 and third poker stage 514. In other embodiments, each poker stage may have cards separately dealt and drawn, or another relationship between the stages may exist. After cards are held, draw cards are drawn to replace any cards not held to generate a first poker hands in each of the first, second, and third poker stages 510, 512, 514. These first poker hands may be evaluated using the 5-card poker paytable. Two additional cards are then dealt to the second card positions 518 in each of the poker stages 510, 512, 514 to create second poker hands for each of the poker stages along with the five cards in the first portion of cards positions 516 of the respective poker stages. These second poker hands may be evaluated using seven card poker paytable, or the best 5-card poker hand may be evaluated using a 5-card poker paytable.

FIGS. 6A, 6B, 6C, and 6D are diagrams of a display of a gaming device showing a game progression of a poker game having additional award opportunities according to embodiments. Referring to FIGS. 6A-6D, a gaming display 600 of a gaming device includes a poker paytable 602, a game play area having a poker hand 610 of playing cards 620, and a player interface area having hold buttons 630, a total bet meter 646, a paid meter 644, a credit meter 642, and a Deal/Draw button 640. The poker hand 610 includes a first portion of card positions 611, which along with the hold buttons 630 are used to make a 5-card first draw poker hand, and a second portion of card positions 612, which in this embodiment are two additional cards. Although this embodiment shows particular features, these features may be different in other embodiments.

Figure 6A:
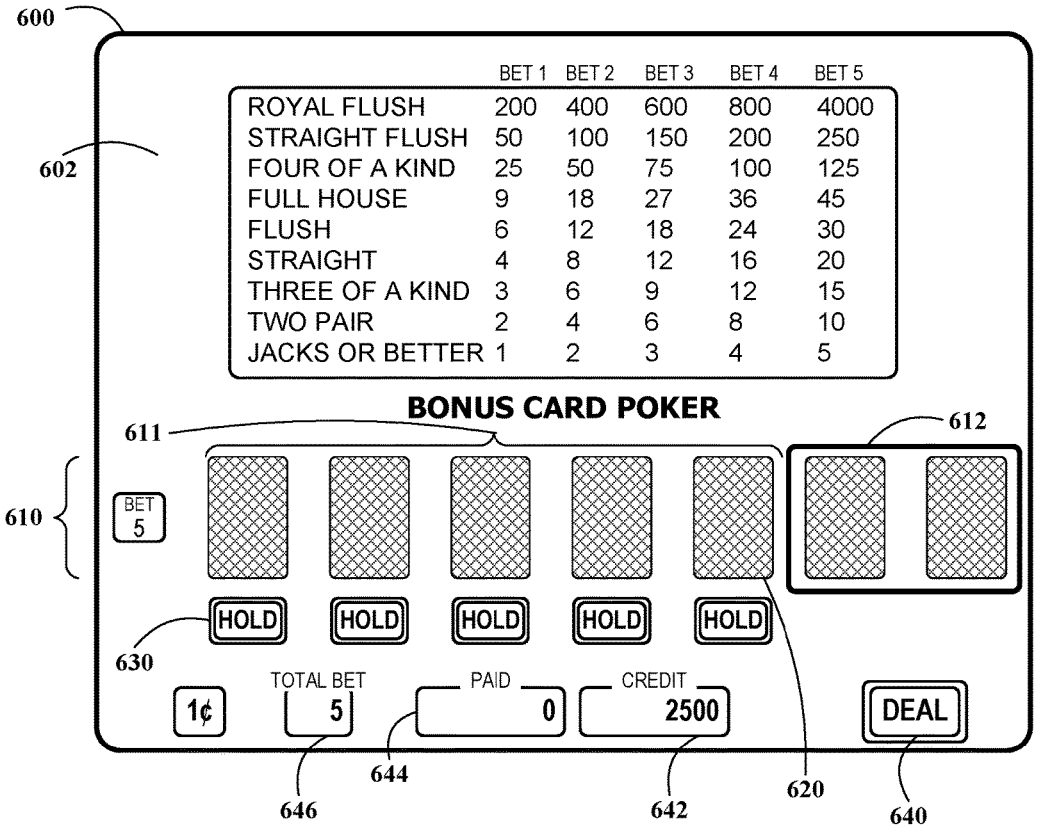
FIGS. 6A, 6B, 6C, and 6D are diagrams of a display of a gaming device showing a game progression of a poker game having additional award opportunities according to embodiments.
Figure 6B:
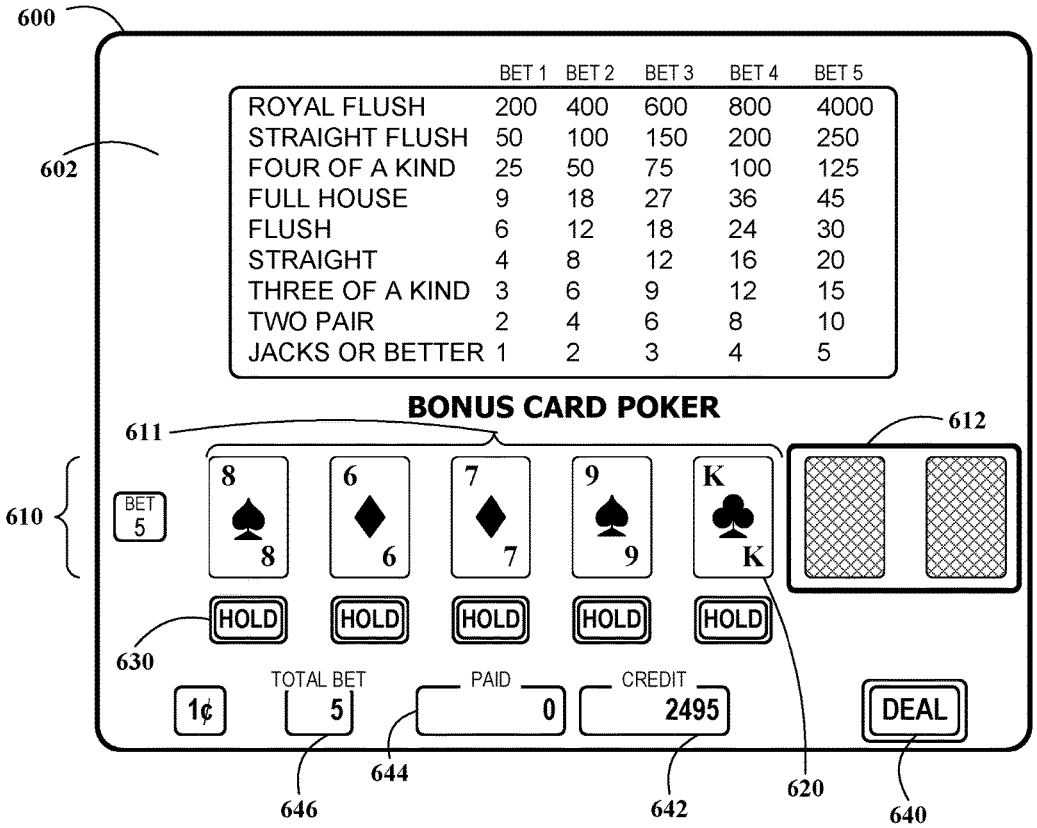
Figure 6C:
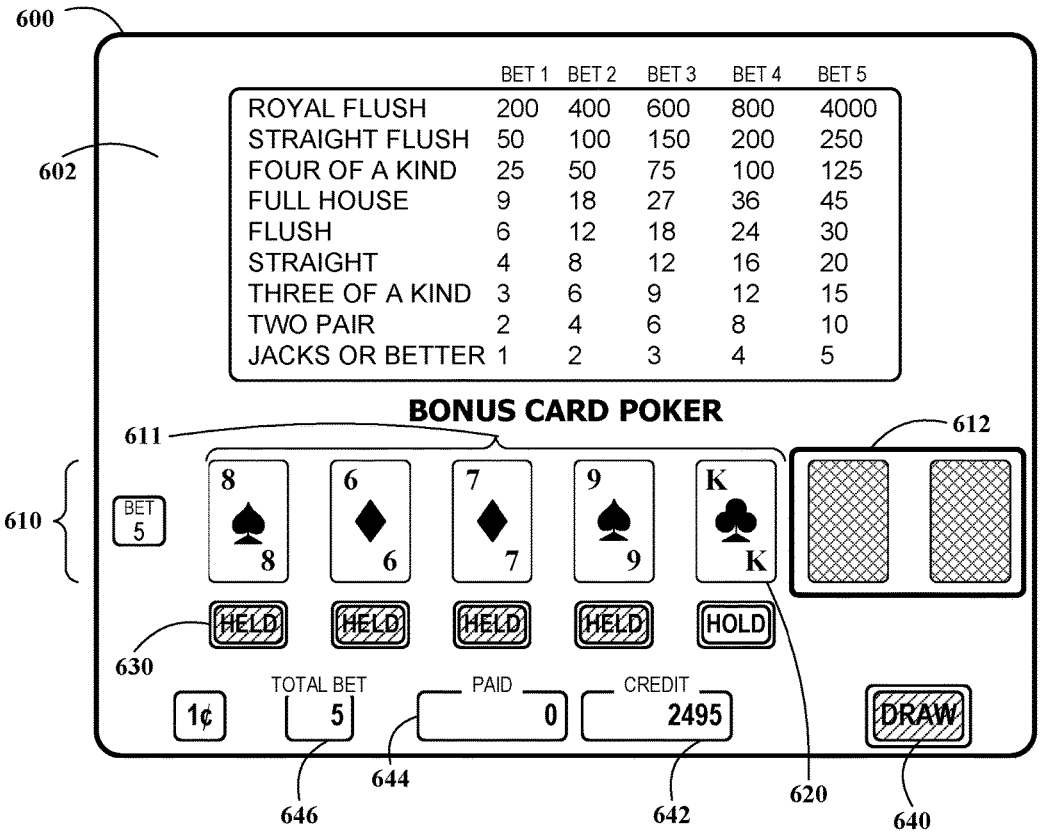

Referring to FIG. 6A, a wager of five credits is ready to be placed on the poker game having additional award opportunities. In FIG. 6B, this wager of five credits has been placed, as shown by the deduction of five credits from the credit amount shown on the credit meter 642. With the wager being placed, five cards from a deck of playing cards are dealt to the first portion of card positions 611 in the poker hand 610. In FIG. 6C, the gaming device has received signals indicating that the first four cards 620 in the first portion of card positions 611 have been held. The hold buttons 630 may be activated by a player to hold these respective cards, or another mechanism may be used to generate the signal indicating which cards are held, such as receiving a signal from physical buttons on a player interface portion of the gaming device, or receiving signals that the area over a particular card has been pressed on a touchscreen panel of the game display 600.

Figure 6D:
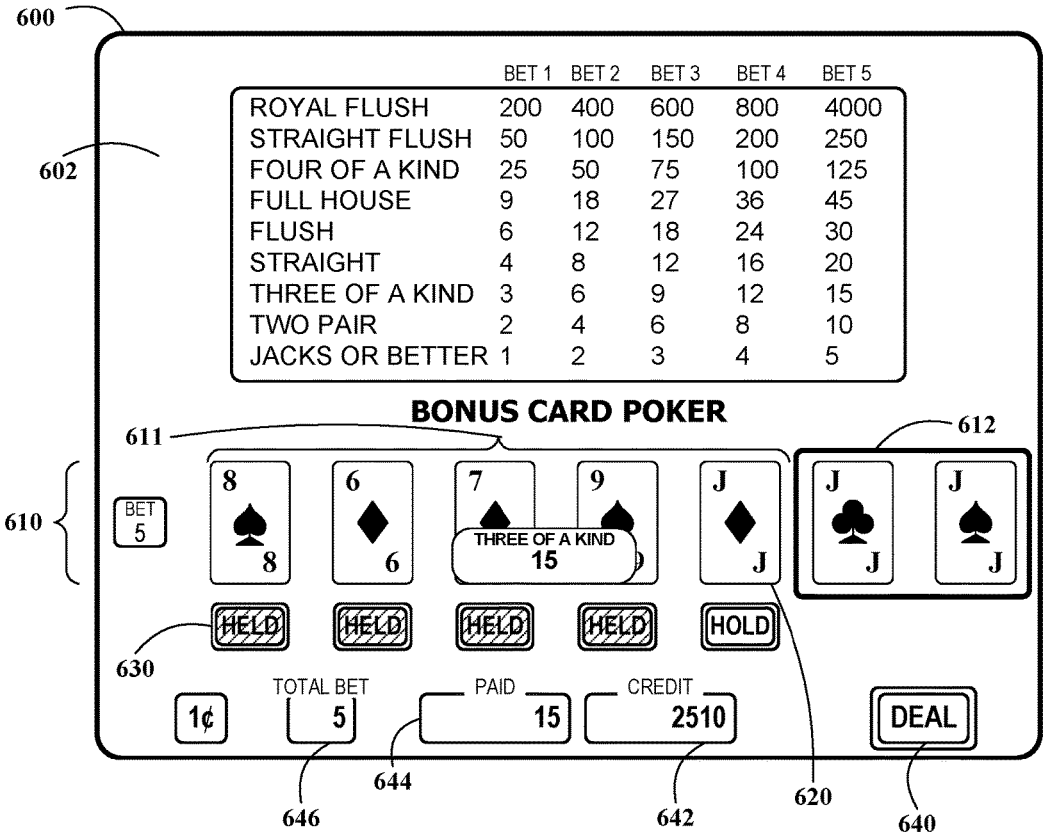

As shown in FIG. 6C, the 8-S, 6-D, 7-D, and 9-S cards 620 have been held as with a player likely hoping to draw a card with a rank of 5 or 10 to complete a winning straight poker hand. After a signal is received indicating that non-held cards are to be discarded and replaced by draw cards (as shown by the deal/draw button 640 being activated), the K-C is discarded and a J-D is drawn to the fifth card position in the first portion of card positions 611, as shown in FIG. 6D. This 5-card draw poker has is evaluated and no winning hand has occurred. Subsequently, two additional cards have been dealt to the second portion of card positions 612. As shown in FIG. 6D, these cards are the J-C, and J-S. This 7-card poker hand is then evaluated for awards. In some embodiments, the 7-card poker had is evaluated using a different 7-card poker paytable, while in other embodiments, the best 5-card poker hand of the seven cards is evaluated using either the same 5-card poker paytable that was used for the 5-card poker hand, or a different 5-card poker table may be used for the evaluation. In this case, the three jacks make a three of a kind winning poker hand, and 15 credits are awarded to the player, as shown in the paid meter 644 and the increase in the credit amount shown in the credit meter 642.

Although not shown in the these figures, other embodiments may allow a player to hold cards in the seven card poker hand and draw to create a new 7-card poker hand. For example, if the 7-card hand was the one shown in FIG. 6D, the player may hold the three jacks (J-D, J-C, J-S) and draw four new cards to try for the last jack (J-H) to create a four of a kind winning hand. In yet, other embodiments, the first five cards in the first portion of card positions 611 may be dealt and evaluated as a 5-card stud poker hand, two additional cards may then be dealt to the second portion of card positions 612 and the 7-card hand may be evaluated either using a 7-card paytable or the best five cards could be evaluated using a 5-card paytable. Alternatively, after the 5-card stud poker hand is evaluated and the two additional cards are dealt to the second portion of cards positions 612, a player may be able to hold cards in the 7-card hand and draw new cards to replace any cards not held. Many other variations may exist in the number, order, style, and/or evaluation of these card hands.

FIGS. 7A, 7B, 7C, 7D, 7E, and 7F are diagrams of a display of a gaming device showing a game progression of another poker game having additional award opportunities according to embodiments. Referring to FIGS. 7A-7F, a gaming display 700 of a gaming device includes a game play area having a first poker hand or stage 710 of playing cards 720, a second poker hand or stage 712 of player cards, a third poker hand or stage 714 of playing cards, and a player interface area having hold buttons 730, a total bet meter 746, a paid meter 744, a credit meter 742, and a Deal/Draw button 740. Although this embodiment shows particular features, these features may be different in other embodiments.

Figure 7A:
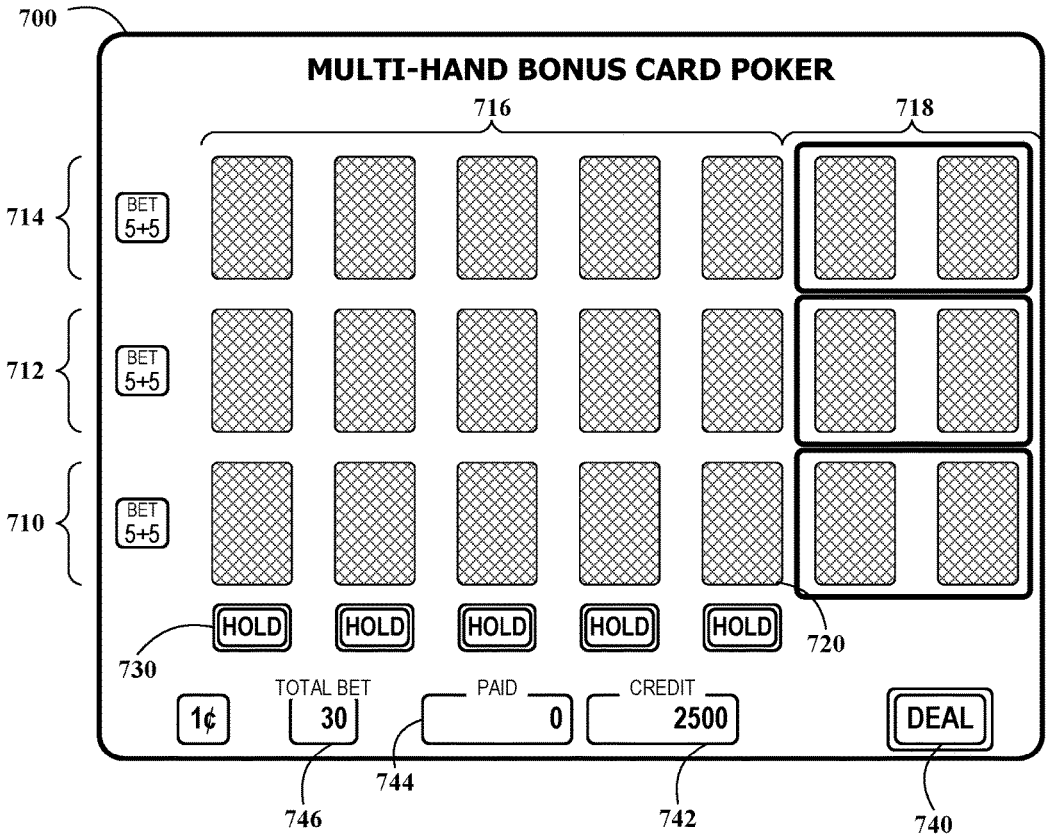
FIGS. 7A, 7B, 7C, 7D, 7E, and 7F are diagrams of a display of a gaming device showing a game progression of another poker game having additional award opportunities according to embodiments.
Figure 7B:
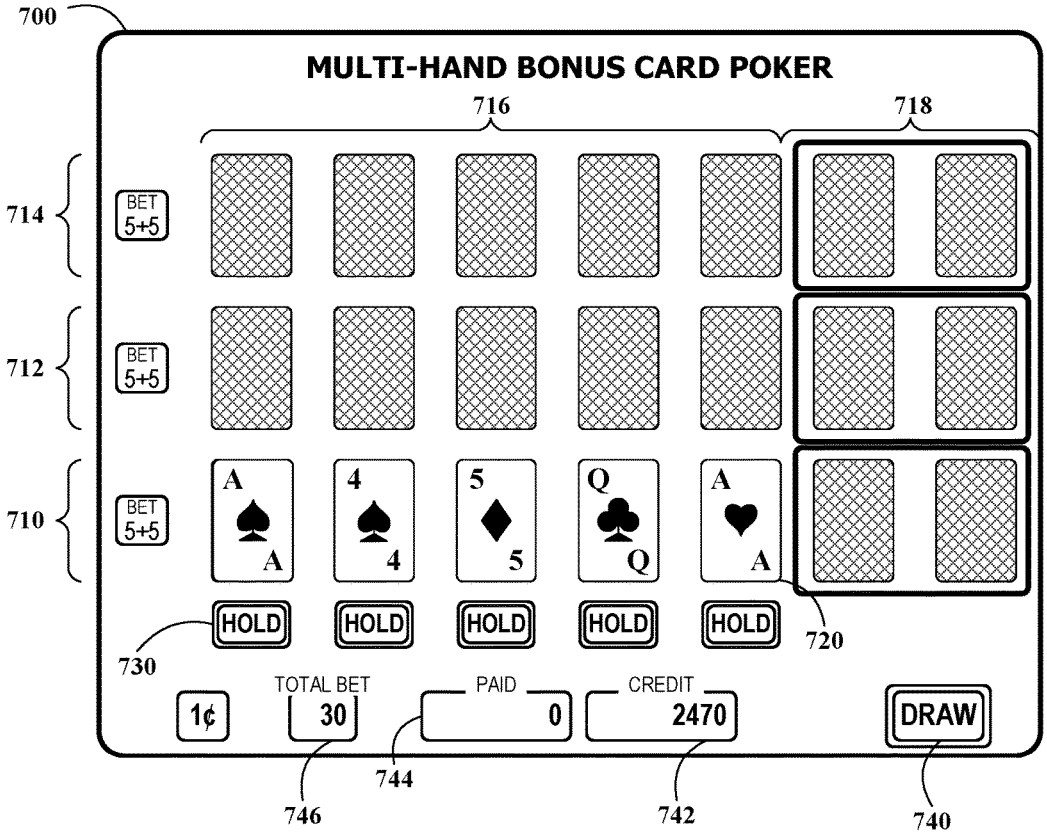
Figure 7C:
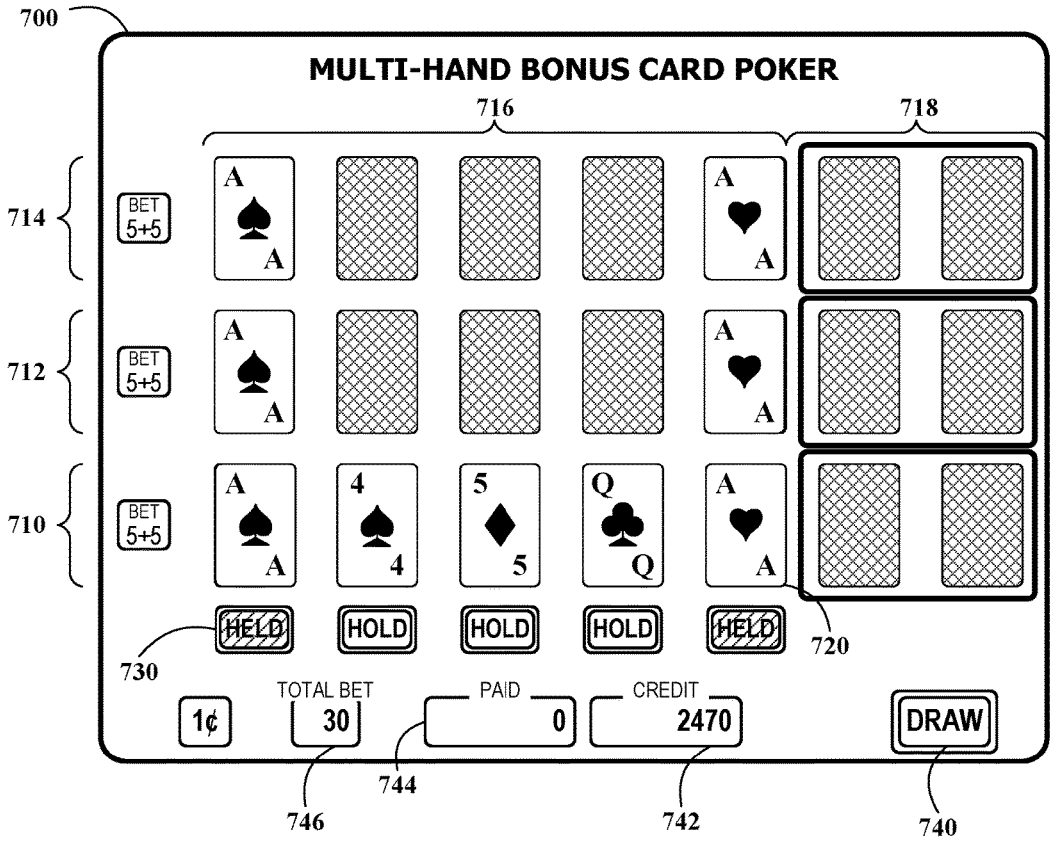
Figure 7D:
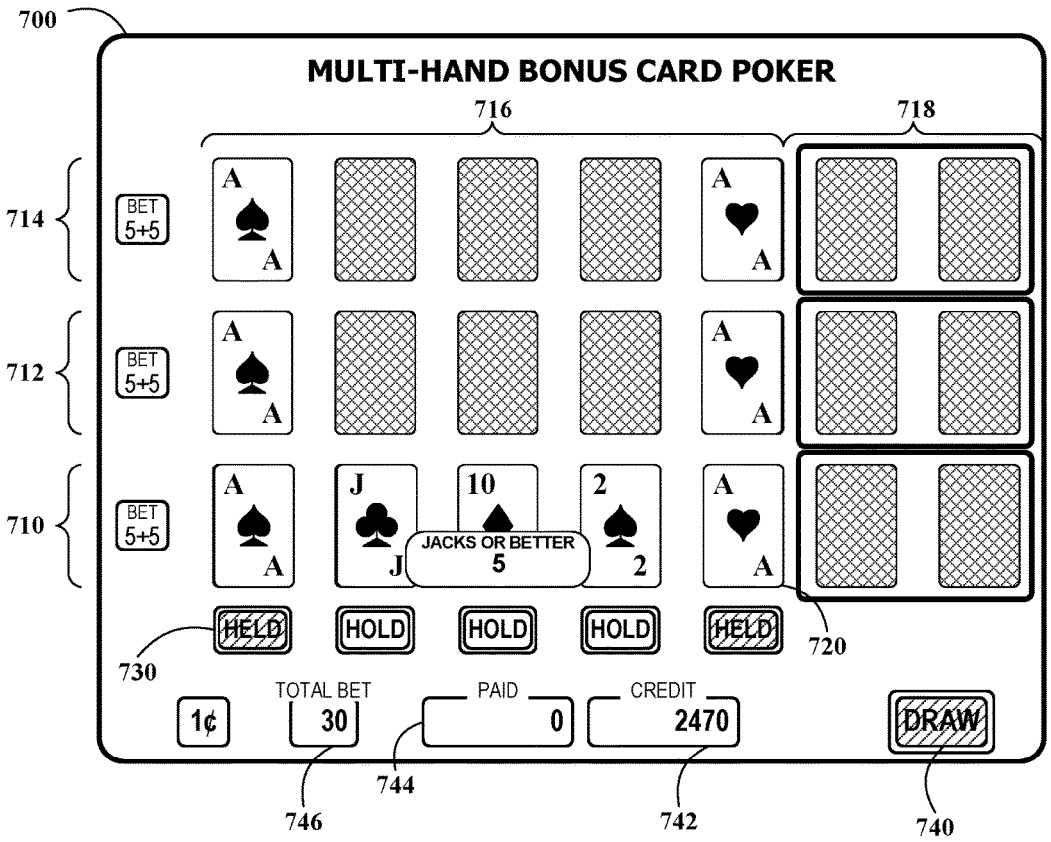
Figure 7E:
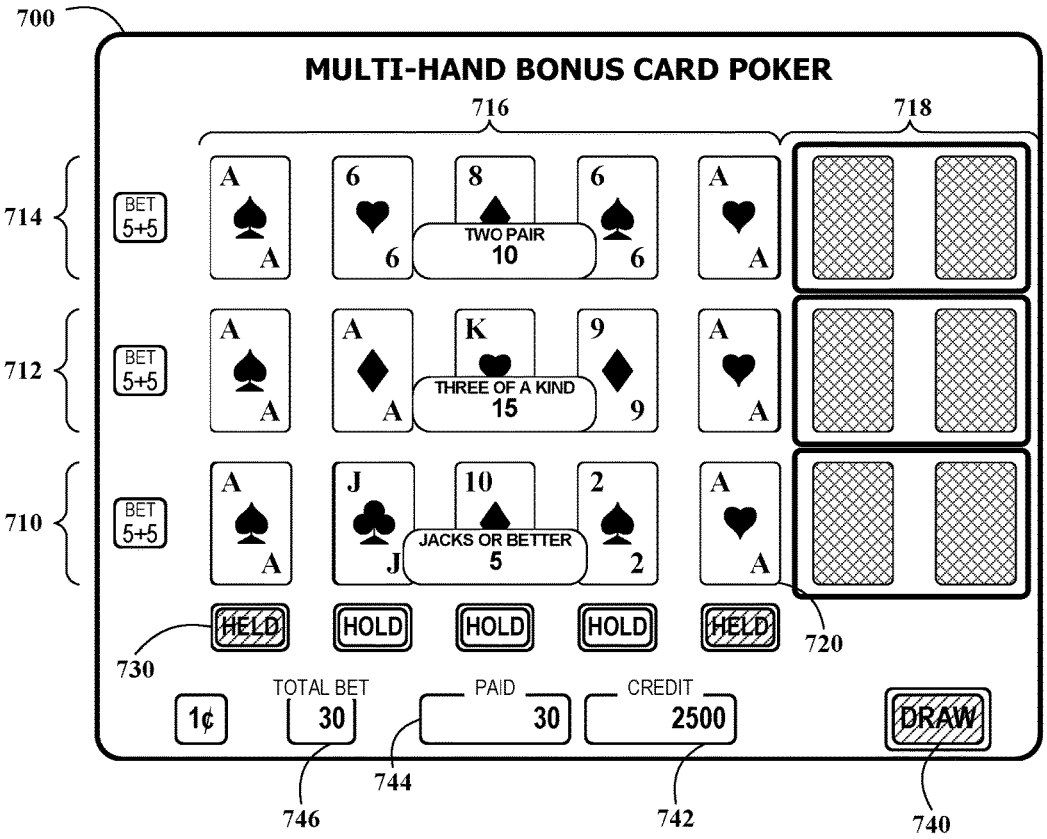
Figure 7F:
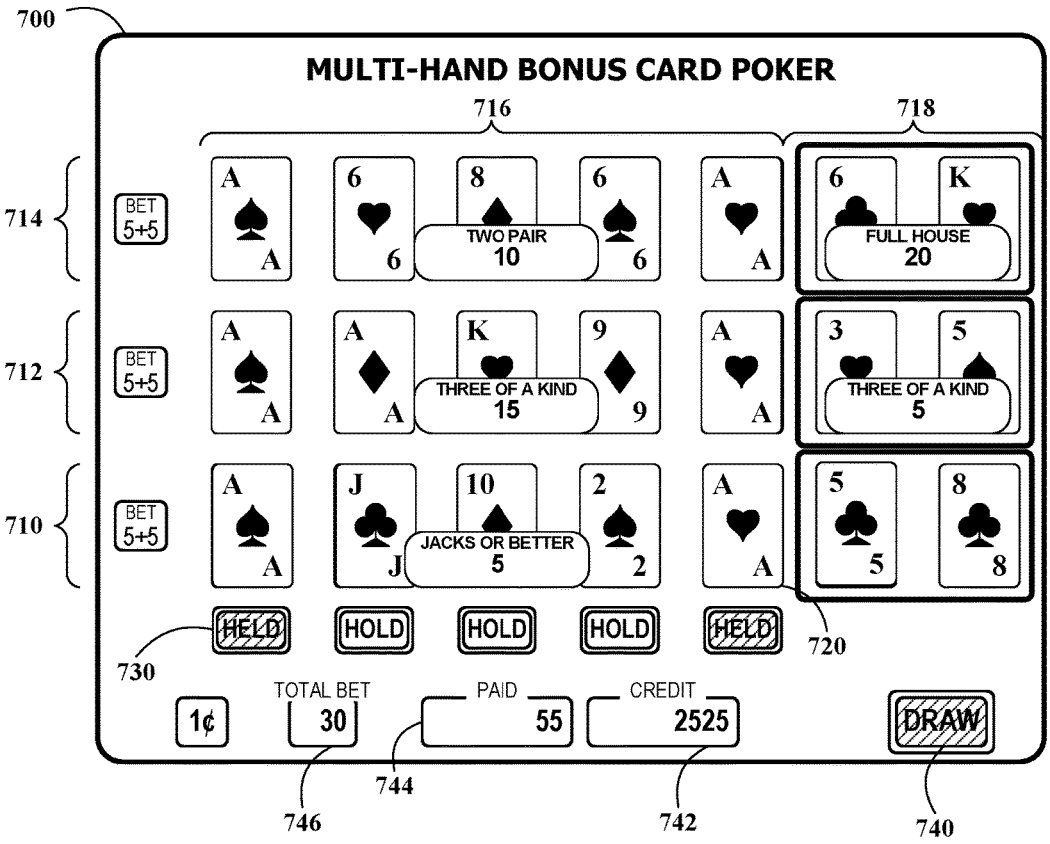

Each of the poker hands or stages 710, 712, 714 include a first portion of card positions 716, which along with the hold buttons 730 are used to make a 5-card first draw poker hands, and a second portion of card positions 718, which in this embodiment are two additional card. In FIG. 7B, five cards are dealt to the first portion of card positions 716 of the first poker stage 710. These dealt cards may be held using the hold buttons 730 or other holding mechanisms. When cards 720 are held, identical cards are replicated to the corresponding card positions in the second poker stage 712 and third poker stage 714 as shown in FIG. 7C. When the Draw button 740 or other mechanism is activated to draw cards, draw cards are used to replace any non-held cards in the first poker hand 716 of the first poker stage 710, as shown in FIG. 7D, and cards are drawn to complete the first poker hands 716 of the second and third poker stages 712, 714, as shown in FIG. 7E. These first poker hands 716 of the first, second, and third poker stages 710, 712, and 714 are then evaluated using a 5-card poker paytable. As shown in FIG. 7F, after this initial evaluation, two additional cards are dealt in the second card positions 718 of the first, second, and third poker stages 710, 712, 714. These second poker hands are then each evaluated using a 7-card poker paytable.

Although not shown in FIGS. 7A-7F, the three poker hands or stages 710, 712, 714 may be independent poker hands in other embodiments. In yet other embodiments, the number of poker hands or stages may vary, the types of poker hands (i.e., stud hands, draw hands, Pai Gow hands, hold 'em hands, etc.), the paytables used in evaluating the hands, and other variables may be altered as discussed above.

The foregoing description of the exemplary embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out in the appended claims.

The invention claimed is:

1. A gaming apparatus comprising:

a video display device including a first poker stage having a first portion of card positions and second portion of card positions, a second poker stage having a first portion of card positions and second portion of card positions, and a third poker stage having a first portion of card positions and second portion of card positions;

a player interface including at least one button, the button configured to generate a signal in response to being activated;

a wager input device structured to receive physical items representing a currency amount;

a memory storing a credit amount; and game circuitry operable to:

receive a signal from the wager input device indicating receipt of a physical item representing currency, increase the credit amount stored in memory based on the currency amount associated with the received physical item, receive a wager on a poker game, where an amount of the wager is deducted from the credit amount stored in the memory, deal a first dealt poker hand of playing cards to the first portion of card positions in the first poker stage, facilitate identification of which of the plurality of cards to hold in the first dealt poker hand, automatically hold cards in the first portion of card positions in the second poker stage and the first portion of card positions in the third poker stage that positionally correspond to the held cards in the first portion of card positions in the first poker stage, replace the cards that are not held in the first dealt poker hand to form a first poker hand, replace the cards that were not automatically held in the first portion of card positions in the second poker stage and the first portion of card positions in the third poker stage to respectively generate a second poker hand and a third poker hand, evaluate the first poker hand, the second poker hand, and the third poker hand for awards, deal cards to the second portion of card positions in the first poker stage to combine with the cards of the first poker hand to form a fourth poker hand, deal cards to the second portion of card positions in the second poker stage to combine with the cards of the second poker hand to form a fifth poker hand, deal cards to the second portion of card positions in the third poker stage to combine with the cards of the third poker hand to form a sixth poker hand, evaluate the fourth poker hand, fifth poker hand, and sixth poker hand for awards, and increase the credit amount based on any awards identified by the evaluations of the first poker hand, the second poker hand, the third poker hand, the fourth poker hand, the fifth poker hand, and the sixth poker hand.

2. The gaming apparatus of claim 1, wherein the first portion of card positions in the first poker stage, the first portion of card positions in the second poker stage, and the first portion of card positions in the third poker stage are each five card positions.

3. The gaming apparatus of claim 1, wherein the player interface includes a plurality of physical buttons corresponding to a number of card positions in the first portion of card positions in the first poker stage.

4. The gaming apparatus of claim 2, wherein the second portion of card positions in the first poker stage, the second portion of card positions in the second poker stage, and the second portion of card positions in the third poker stage are each one card position.

5. The gaming apparatus of claim 2, wherein the second portion of card positions in the first poker stage, the second portion of card positions in the second poker stage, and the second portion of card positions in the third poker stage are each two card positions.

6. The gaming apparatus of claim 5, wherein evaluating the first poker hand, the second poker hand, and the third poker hand for awards includes evaluating the first poker hand, the second poker hand, and the third poker hand using a first 5-card paytable.

7. The gaming apparatus of claim 6, wherein evaluating the fourth poker hand, the fifth poker hand, and the sixth poker hand for awards includes evaluating the fourth poker hand, the fifth poker hand, and the sixth poker hand using a 7-card paytable.

8. The gaming apparatus of claim 6, wherein evaluating the fourth poker hand, the fifth poker hand, and the sixth poker hand for awards includes:

determining a best 5-card fourth poker hand from the fourth poker hand;

determining a best 5-card fifth poker hand from the fifth poker hand; and determining a best 5-card sixth poker hand from the sixth poker hand.

9. The gaming apparatus of claim 8, wherein evaluating the fourth poker hand, the fifth poker hand, and the sixth poker hand for awards further includes evaluating the best 5-card fourth poker hand, the best 5-card fifth poker hand, and the best 5-card sixth poker hand using the first 5-card paytable.

10. The gaming apparatus of claim 8, wherein evaluating the fourth poker hand, the fifth poker hand, and the sixth poker hand for awards further includes evaluating the best 5-card fourth poker hand, the best 5-card fifth poker hand, and the best 5-card sixth poker hand using a second 5-card paytable.

11. A method of operating a gaming apparatus including a video display device, a player interface, a wager input device structured to receive physical items representing a currency amount, a memory storing a credit amount, and a processor, where the video display includes a first poker stage having a first portion of card positions and second portion of card positions, a second poker stage having a first portion of card positions and second portion of card positions, and a third poker stage having a first portion of card positions and second portion of card positions, the method comprising:

receiving a signal from the wager input device indicating receipt of a physical item representing currency, increasing the credit amount stored in memory based on the currency amount associated with the received physical item, receiving a wager on a poker game, where an amount of the wager is deducted from the credit amount stored in the memory, dealing a first dealt poker hand of playing cards to the first portion of card positions in the first poker stage, facilitating identification of which of the plurality of cards to hold in the first dealt poker hand, automatically holding cards in the first portion of card positions in the second poker stage and the first portion of card positions in the third poker stage that positionally correspond to the held cards in the first portion of card positions in the first poker stage, replacing the cards that are not held in the first dealt poker hand to form a first poker hand, replacing the cards that were not automatically held in the first portion of card positions in the second poker stage and the first portion of card positions in the third poker stage to respectively generate a second poker hand and a third poker hand, evaluating the first poker hand, the second poker hand, and the third poker hand for awards, dealing cards to the second portion of card positions in the first poker stage to combine with the cards of the first poker hand to form a fourth poker hand, dealing cards to the second portion of card positions in the second poker stage to combine with the cards of the second poker hand to form a fifth poker hand, dealing cards to the second portion of card positions in the third poker stage to combine with the cards of the third poker hand to form a sixth poker hand, evaluating the fourth poker hand, fifth poker hand, and sixth poker hand for awards, and increasing the credit amount based on any awards identified by the evaluations of the first poker hand, the second poker hand, the third poker hand, the fourth poker hand, the fifth poker hand, and the sixth poker hand.

12. The method of claim 11, wherein the first portion of card positions in the first poker stage, the first portion of card positions in the second poker stage, and the first portion of card positions in the third poker stage are each five card positions.

13. The method of claim 12, wherein the second portion of card positions in the first poker stage, the second portion of card positions in the second poker stage, and the second portion of card positions in the third poker stage are each one card position.

14. The method of claim 12, wherein the second portion of card positions in the first poker stage, the second portion of card positions in the second poker stage, and the second portion of card positions in the third poker stage are each two card positions.

15. The method of claim 14, wherein evaluating the first poker hand, the second poker hand, and the third poker hand for awards includes evaluating the first poker hand, the second poker hand, and the third poker hand using a first 5-card paytable.

16. The method of claim 15, wherein evaluating the fourth poker hand, the fifth poker hand, and the sixth poker hand for awards includes evaluating the fourth poker hand, the fifth poker hand, and the sixth poker hand using a 7-card paytable.

17. The method of claim 15, wherein evaluating the fourth poker hand, the fifth poker hand, and the sixth poker hand for awards includes:

determining a best 5-card fourth poker hand from the fourth poker hand;

determining a best 5-card fifth poker hand from the fifth poker hand; and determining a best 5-card sixth poker hand from the sixth poker hand.

18. The method of claim 17, wherein evaluating the fourth poker hand, the fifth poker hand, and the sixth poker hand for awards further includes evaluating the best 5-card fourth poker hand, the best 5-card fifth poker hand, and the best 5-card sixth poker hand using the first 5-card paytable.

19. The method of claim 17, wherein evaluating the fourth poker hand, the fifth poker hand, and the sixth poker hand for awards further includes evaluating the best 5-card fourth poker hand, the best 5-card fifth poker hand, and the best 5-card sixth poker hand using a second 5-card paytable.

* * * * *